United States Patent [19]

Weiler et al.

[11] Patent Number: 4,569,456

[45] Date of Patent: Feb. 11, 1986

[54] SEALED CONTAINER WITH REPLACEABLE PLUG INSERT

[75] Inventors: Gerhard H. Weiler, South Barrington; Louis T. Pagels, Hanover Park, both of Ill.

[73] Assignee: Automatic Liquid Packaging, Inc., Arlington Heights, Ill.

[21] Appl. No.: 627,090

[22] Filed: Jul. 2, 1984

[51] Int. Cl.[4] ..... B65D 41/40; B65D 51/20

[52] U.S. Cl. ..... 215/251; 220/257; 215/252; 215/253

[58] Field of Search ..... 215/251, 252, 253; 220/257, 254

[56] References Cited

U.S. PATENT DOCUMENTS

| | | | |
|---|---|---|---|
| 3,191,790 | 6/1965 | Coven et al. | 215/251 |
| 3,920,141 | 11/1975 | Bojardi | 215/251 |
| 4,171,236 | 10/1979 | Winchell et al. | 215/253 |
| 4,298,045 | 11/1981 | Weiler | 150/500 |

FOREIGN PATENT DOCUMENTS

| | | | |
|---|---|---|---|
| 2377943 | 9/1978 | France | 215/355 |

*Primary Examiner*—John E. Kittle
*Assistant Examiner*—James J. Seidleck
*Attorney, Agent, or Firm*—Dressler, Goldsmith, Shore, Sutker & Milnamow

[57] ABSTRACT

A hermetically sealed container formed from thermoplastic material is provided with a hollow body having an open end terminating in a tapered wall defining a sealing region about an opening with a decreasing cross-sectional area in the direction toward the interior of the hollow body. A hollow plug insert is provided in the opening and has a peripheral sealing surface generally complementary with the defined sealing region. Over the opening is a closure structure that is unitary with the hollow body, that encloses the plug insert, and that retains the plug insert in the opening. A severable frangible web joins the closure structure to the hollow body outwardly of the opening.

13 Claims, 4 Drawing Figures

SEALED CONTAINER WITH REPLACEABLE PLUG INSERT

TECHNICAL FIELD

This invention relates to thermoplastic containers which are hermetically sealed and which can be opened by fracturing, severing, breaking, or rupturing a frangible web.

BACKGROUND OF THE INVENTION

Hermetically sealed containers with unitary closures are known in the art. Generally, such containers are fabricated using apparatus and methods for forming, filling, and sealing as disclosed generally in U.S. Pat. Nos. 3,597,793; 3,919,374; 4,239,726; 4,298,045; and U.S. Pat. No. Re. 27,155, as well as in the patents cited in these patents. Such sealed containers of unitary construction may be provided with a closure that can be severed to permit removal of the closure and to permit access to the contents in the container. Containers of this general type are well suited for sterile and aseptic packaging of various liquids.

A number of designs that have been proposed for unitary containers with severable closures typically employ a frangible web to join the closure or cap portion with the container. Tabs or other members may be provided on the closure or cap portion to enable the structure to be conveniently gripped with sufficient leverage so that the container can be easily opened by twisting off the cap portion. Examples of such designs are disclosed in U.S. Pat. Nos. 4,298,045, 4,258,867, and 4,239,726.

It is also known to provide a solid stopper which is partially encapsulated in place in an opening in a molded thermoplastic container. See for example U.S. Pat. No. 4,226,334. Another design for a container with a solid stopper partially encapsulated at the bottom of a container is disclosed in U.S. Pat. No. 3,919,374.

Although the above-discussed containers may be satisfactory for the applications for which they were designed, it would be desirable to provide an improved container having advantages not found in such conventional designs. Specifically, when containers having a frangible web and severable cap portion are used to collect samples that subsequently need to be shaken or agitated, it would be advantageous to provide a container structure that could accommodate a secondary seal or temporary closure after the hermetically sealed cap portion has been removed. The present invention provides such a container.

SUMMARY OF THE INVENTION

A hermetically sealed container embodying the invention includes a hollow body portion having an open end terminating in a tapered wall defining a sealing region about an opening. The sealing region has a decreasing cross-sectional area in the direction toward the interior of the body.

A hollow plug insert is provided in the opening and has a peripheral sealing surface generally complementary with the defined sealing region. The plug insert is positioned to effect a fluid-tight seal for the hollow body.

A closure stucture is provided over the hollow body opening and is unitary with the hollow body so as to enclose the plug insert and retain the plug insert in the opening. A severable frangible web is provided for joining the closure structure to the hollow body outwardly of the opening.

The container may also have the form of a hollow body portion open at one end with a neck portion at and about the open end. The neck portion is unitary with the hollow body portion and defines a passageway tapered toward the hollow body portion. The passageway defines an internal, peripheral sealing region.

A hollow plug is received within the neck portion and matingly engages the peripheral sealing region to seal the hollow body portion.

A cap is provided for enveloping the plug, for defining a cavity between the cap and the plug, and for holding the plug in place against the peripheral sealing region. The cap is unitary with the neck and body portion, but is delineated by a peripheral frangible web that circumscribes the neck portion on the cap side of the plug.

BRIEF DESCRIPTION OF THE DRAWINGS

In the accompanying drawing forming part of the specification, in which like numerals are employed to designate like parts throughout the same.

DESCRIPTION OF PREFERRED EMBODIMENT

Figure 1:
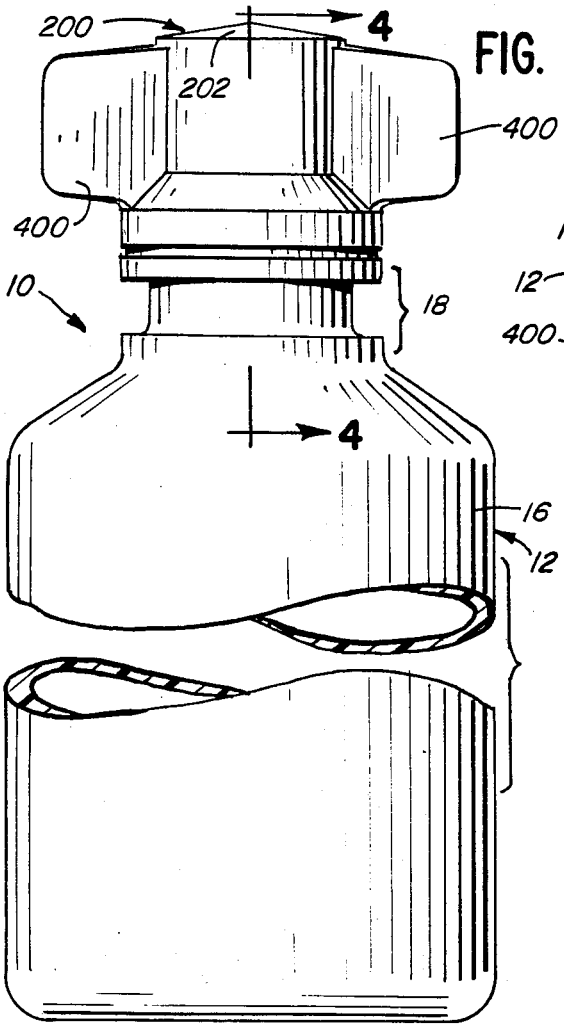
FIG. 1 is a front elevational view of a hermetically sealed container fabricated in accordance with the teachings of the present invention.

The invention disclosed herein is, of course, susceptible of embodiment in many different forms. Shown in the drawing and described hereinbelow in detail is a preferred embodiment of the invention. It is to be understood, however, that the present disclosure is an exemplification of the principles of the invention and does not limit the invention to the illustrated embodiment.

For ease of description, a container embodying the present invention is described hereinbelow in its usual assembled configuration and normal orientation as shown in the accompanying drawing, and terms such as upper, lower, horizontal, etc., will be used herein with reference to this usual orientation. However, the container may be manufactured, stored, transported, sold, or used in orientations other than that described and shown herein.

The container may be fabricated by suitable methods incorporating some of the processes generally described in U.S. Pat. No. Re. 27,155 and U.S. Pat. No. 3,919,374. Apparatus for carrying out such patented processes in the form of molding, filling, and sealing machines are sold by Automatic Liquid Packaging, Inc., 2445 East Oakton Street, Arlington Heights, Ill. 60005, U.S.A. It is to be understood that appropriate modifications of such machines would be necessary to permit utilization of such machines in the manufacture of the container of the present invention.

Further, while economical advantages are readily realized by the automatic forming, filling, and hermetic sealing as taught in the foregoing patents, the container of the present invention can also be formed first and then filled and sealed in separate operations, if desired.

Figure 4:
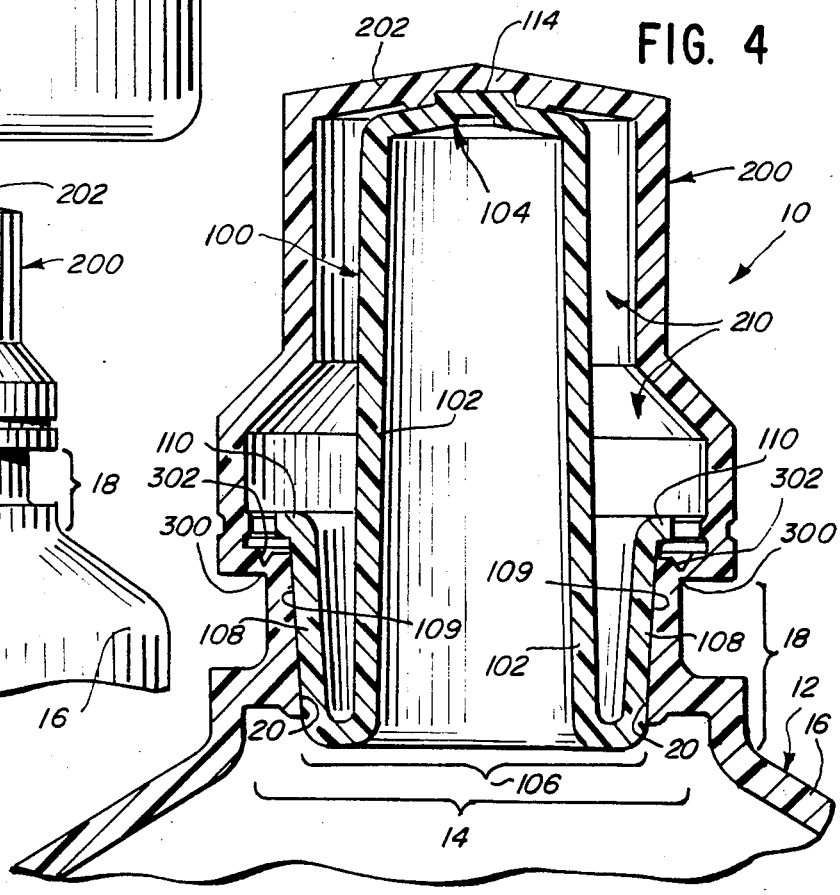
FIG. 4 is an enlarged, fragmentary, cross-sectional view taken generally along the plane 4—4 in FIG. 1.

Referring now to the drawing, the container is designated generally by the reference numeral 10 and includes a plug or plug insert which is designated by the reference numeral 100 (FIG. 4 only). The container of the present invention, including the plug or plug insert, is preferably fabricated from conventional thermoplastic molding materials such as polyethylene (low and high density), polypropylene, polycarbonate, polyester, and like materials compatible with the container contents. The plug or plug insert may be fabricated, prior to the fabrication of the remaining portions of the container, by injection molding techniques or other suitable techniques.

The container 10 includes a hollow body 12 which has an open end 14 (FIG. 4 only). In the embodiment illustrated, the hollow body 12 includes a lower hollow body portion 16 open at the end 14 and an upper neck portion 18 about the open end 14. The hollow body 12 can thus be regarded as terminating in the neck portion 18. The hollow body portion 16 typically includes a transition section which merges with, and joins, the bottom of the neck portion 18. The neck portion 18 defines a passageway or tapered wall 20 (FIG. 4 only) which functions as an internal, peripheral sealing region that decreases in cross-sectional area in the direction toward the interior of the hollow body 12.

The plug or plug insert 100 is provided in the open end 14 to occlude the opening at the open end. The plug 100 is a hollow, elongated member received within the neck portion 18, and the plug 100 matingly engages the peripheral sealing region on the wall 20 to seal the hollow body 12.

In the preferred embodiment illustrated in FIG. 4, the plug 100 has three main parts: (a) a generally frustoconical, hollow, central portion 102, (b) an end wall 104 closing one end of the central portion 102, and (c) an enlarged open end portion 106 opposite the end wall 104.

The enlarged open end portion 106 of the plug 100 has an outwardly curved flange 108 that is spaced from, but extends along, the outer surface of the plug central portion 102. The flange 108 terminates in an outwardly turned retaining lip 110 that has an outside dimension greater than the largest complementary inside dimension of the passageway defined by the tapered wall 20. This retaining lip 110 thus serves as a stop for the plug 100 and prevents the plug 100 from being pushed too far inwardly into the container body 12. In addition, the lip 110 functions to make the plug flange 108 more stiff.

The exterior of the outwardly curved flange 108 defines a peripheral sealing surface 109 that is generally complementary with the defined sealing region of the tapered wall 20. The plug 100 is thus capable of being positioned to effect a fluid-tight seal.

The plug end wall 104 includes a generally planar land portion 114 (FIG. 4 only). The land portion 114 is adapted to be engaged by the container closure structure or cap 200 which is described in detail below.

The closure structure 200 is provided over the container opening 14. The closure structure 200 is unitary with the hollow body 12 and encloses or envelopes the plug 100. The closure structure 200 also functions to hold the plug 100 in place against the peripheral sealing region of the tapered wall 20. To this end, the closure structure or cap 200 includes an end wall 202 which abuts the land portion 114 of the plug outwardly projecting central portion 102. In the preferred embodiment illustrated, the closure structure 200 defines a cavity 210 surrounding a portion of the plug 100. Specifically, the cavity 210 has a generally annular configuration around the exterior surface of the central portion 102 of the plug 100.

The container 10 includes a severable frangible web 300 joining the closure structure or cap 200 to the hollow body 12 outwardly of the body opening 14. Specifically, the thermoplastic material forming the container 10 defines a circular groove with a generally V-shaped cross-section 302. The frangible web 300 defines a circular line of weakness below the circular groove in the thermoplastic material.

Figure 2:
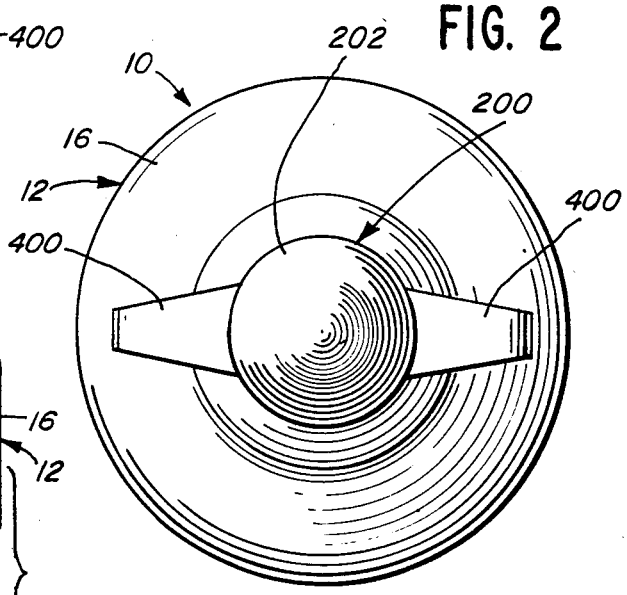
FIG. 2 is a top plan view of the container.
Figure 3:
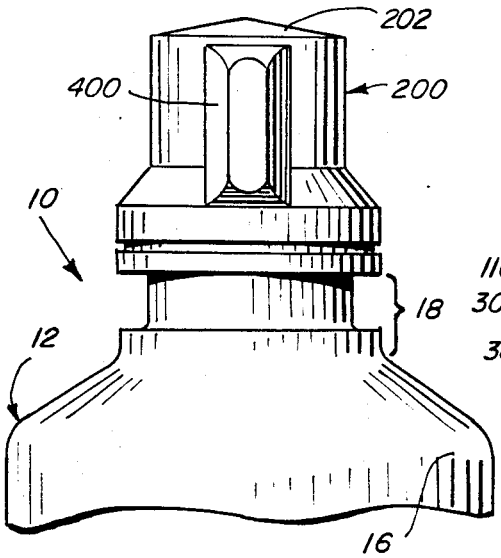
FIG. 3 is a fragmentary side elevational view of the container (shown rotated generally about 90 degrees from the orientation in FIG. 1)

At least one, and preferably two, laterally projecting gripping members or tabs 400 are provided on the closure structure or cap 200 (FIGS. 1–3). These permit the container 10 to be grasped with sufficient leverage so that the container 10 can be easily opened by twisting off the closure structure or cap 200.

Removal of the closure structure 200 provides access to the plug 100. Then, the plug 100 can be gripped by the upwardly projecting central portion 102 and removed from the container body 12 to gain access to the container contents. If not all of the container contents is dispensed from the container 10, the plug 100 can be reinserted into the container to prevent ingress of contaminants. Also, the container 10 may be shaken with the plug 100 in place if desired. A person can easily hold his thumb over the plug 100 during the shaking process to insure that the plug 100 will not become dislodged.

From the foregoing description and the accompaning drawing, it is evident that the present invention provides a novel container offering advantages over the prior art. Although the present invention has been described in conjunction with one illustrated embodiment, it should be understood that various modifications may be used without departing from the spirit and essential characteristics of the invention. Accordingly, all such modifications are intended to be included within the scope of the appended claims.

What is claimed is:

1. A hermetically sealed container formed from thermoplastic material comprising:

a hollow body having an open end terminating in a tapered wall defining a sealing region about an opening with a decreasing cross-sectional area in the direction toward the interior of said hollow body;

a hollow plug insert in said opening, said plug insert having a peripheral sealing surface generally complementary with the defined sealing region, said plug insert being positioned to effect a fluid-tight seal for said hollow body;

a closure structure over said opening, unitary with said hollow body, enclosing said plug insert, and retaining said plug insert in said opening; and a severable frangible web joining said closure structure to said hollow body outwardly of said opening.

2. A container in accordance with claim 1 in which said sealing region of said tapered wall is a frustonical interior surface and in which said plug insert peripheral sealing surface has a complementary frustoconical configuration.

3. The container in accordance with claim 1 in which said thermoplastic material defines a circular groove with a generally V-shaped cross section and in which said frangible web defines a circular line of weakness below said circular groove in said thermoplastic material.

4. The container in accordance with claim 1 in which said plug insert has (a) a generally frustoconical, hollow, central portion, (b) an end wall closing one end of said central portion, and (c) an enlarged open end portion opposite said end wall, said enlarged open end portion defining said peripheral sealing surface mating with said sealing region.

5. The container in accordance with claim 4 in which said enlarged open end portion of said plug insert includes an outwardly turned retaining lip extending over the distal end of said hollow body sealing region.

6. The container in accordance with claim 4 in which said end wall of said plug insert includes a generally planar land portion.

7. The container in accordance with claim 1 in which said plug insert has a central portion projecting away from said hollow body and beyond said plug insert peripheral sealing surface, and in which a portion of said closure structure abuts said outwardly projecting central portion.

8. The container in accordance with claim 1 in which said plug insert has an end wall, in which said closure structure defines a cavity surrounding a portion of said plug insert, and in which part of said closure structure receives said plug insert end wall in abutting relationship.

9. The container in accordance with claim 1 in which said closure structure includes at least one laterally projecting gripping member.

10. A hermetically sealed thermoplastic container comprising:

a hollow body portion open at one end;

a neck portion about said open end, unitary with said hollow body portion, and defining a passageway tapered toward the hollow body portion and having an internal, peripheral sealing region;

a hollow plug received within said neck portion and matingly engaging said peripheral sealing region to seal said hollow body portion; and a cap enveloping said plug, defining a cavity between said cap and said plug, and holding said plug in place against said peripheral sealing region; said cap being unitary with said neck portion and with said body portion and being delineated by a peripheral frangible web that circumscribes the neck portion on the cap side of the plug.

11. The container in accordance with claim 10 wherein said cap is provided with laterally extending gripping tabs.

12. The container in accordance with claim 10 wherein said plug is a hollow, elongated member closed at one end and having at the other end an outwardly curved flange that extends along the outer surface of the elongated member.

13. The container in accordance with claim 12 wherein said outwardly curved flange terminates in a retaining lip that has an outside dimension greater than the largest complementary inside dimension of said passageway.

* * * * *